US006930680B2

(12) United States Patent
Miyazawa

(10) Patent No.: US 6,930,680 B2
(45) Date of Patent: Aug. 16, 2005

(54) PIXEL CIRCUIT FOR LIGHT EMITTING ELEMENT

(75) Inventor: Takashi Miyazawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 420 days.

(21) Appl. No.: 10/316,115

(22) Filed: Dec. 11, 2002

(65) Prior Publication Data

US 2003/0122745 A1 Jul. 3, 2003

(30) Foreign Application Priority Data

Dec. 13, 2001 (JP) ..... 2001-379714

(51) Int. Cl.[7] ..... G09G 5/00
(52) U.S. Cl. ..... 345/205; 345/76
(58) Field of Search ..... 345/76, 82, 205, 345/206

(56) References Cited

U.S. PATENT DOCUMENTS

| | | | | |
|---|---|---|---|---|
| 5,748,165 | A | 5/1998 | Kubota et al. | |
| 5,900,856 | A | 5/1999 | Iino et al. | |
| 5,903,246 | A | 5/1999 | Dingwall | |
| 5,914,699 | A | 6/1999 | Imamura | |
| 5,952,789 | A | 9/1999 | Stewart et al. | |
| 6,191,768 | B1 | 2/2001 | Imamura | |
| 6,222,515 | B1 | 4/2001 | Yamaguchi et al. | |
| 6,229,506 | B1 | 5/2001 | Dawson et al. | |
| 6,252,572 | B1 | 6/2001 | Kurumisawa et al. | |
| 6,297,792 | B1 | 10/2001 | Takahashi | |
| 6,369,786 | B1 | 4/2002 | Suzuki | |
| 6,501,466 | B1 * | 12/2002 | Yamagishi et al. | 345/204 |
| 2002/0050962 | A1 * | 5/2002 | Kasai | 345/76 |
| 2003/0030602 | A1 * | 2/2003 | Kasai | 345/76 |
| 2003/0040149 | A1 * | 2/2003 | Kasai | 438/200 |
| 2003/0128200 | A1 * | 7/2003 | Yumoto | 345/211 |

FOREIGN PATENT DOCUMENTS

| | | |
|---|---|---|
| EP | 1 061 497 A1 | 12/2000 |
| JP | A 11-282419 | 10/1999 |
| JP | A 2001-147659 | 5/2001 |
| WO | WO 99/38148 | 7/1999 |
| WO | WO 99/65012 | 12/1999 |
| WO | WO 02/071379 A2 | 9/2002 |

OTHER PUBLICATIONS

Johnson et al., "Active Matrix PolyLED Displays", Philips Research Laboratories, IDW, pp. 235–238, 2000.
Bae et al., "A Novel Pixel Design for an Active Matrix Organic Light Emitting Diode Display", SID, pp. 358–361, 2000.
Yumoto et al., "Pixel–Driving Methods for Large–Sized Poly–Si AM–OLED Displays", Asia Display, IDW, pp. 1395–1398, 2001.

* cited by examiner

*Primary Examiner*—Richard Hjerpe
*Assistant Examiner*—Rodney Amadiz
(74) *Attorney, Agent, or Firm*—Oliff & Berridge, PLC

(57) ABSTRACT

Pixel circuit 210 includes a current programming circuit 240 and voltage programming transistors 251 and 252. In order to set the tone of the light emission from the organic EL element 220, the first and second voltage programming transistors 251 and 252 are set to the OFF and ON state, respectively, and voltage programming is carried out using a voltage signal Vout. Next, the states of the first and second voltage programming transistors 251 and 252 are switched, and current programming is carried out using a current signal Iout.

12 Claims, 14 Drawing Sheets

Fig.5(d) Vout

Fig.5(e) Iout

Fig.5(f) IEL

Fig.7(d) Vout

Fig.7(e) Iout

Fig.7(f) IEL

Fig.9(d) Vout

Fig.9(e) Iout

Fig.9(f) IEL

Tc
Tpr
Tel
Im
Rl
Ima
Fig.11(a) V1
Fig.11(b) V2
Fig.11(c) V3
Fig.11(d) Vout
Fig.11(e) Iout
Fig.11(f) IEL

Fig.13(d) Vout

Fig.13(e) Iout

PIXEL CIRCUIT FOR LIGHT EMITTING ELEMENT

BACKGROUND OF THE INVENTION

1. Field of the Invention

The present invention pertains to a technology for a pixel circuit for a current-driven light emitting element.

2. Description of the Related Art

Electrooptical devices that use organic EL (electroluminescent) elements have been developed in recent years. Because an organic EL element is a self-emitting element and does not require a back light, it is expected to enable the production of display devices having low power consumption, a wide field angle and a high contrast ratio. In this specification, an "electrooptical device" means a device that converts electrical signals into light. The most common implementation of an electrooptical device is a device that converts electrical signals that represent an image into light that represents an image, and this type of device is preferred for display devices in particular.

Existing types of organic EL element pixel circuits include pixel circuits that use the voltage programming method that sets the light emission tone based on the voltage value and pixel circuits that use the current programming method that sets the light emission tone based on the current value. "Programming" refers to the process to set the light emission tone in the pixel circuit. The voltage programming method is relatively fast, but it can result in somewhat inaccurate light emission tone setting. On the other hand, the current programming method sets the light emission tone accurately, but can require a relatively long time to execute.

Accordingly, a pixel circuit that uses a method different from either of the conventional methods has been desired. This demand exists not only for display devices that use organic EL elements, but also for display devices or electrooptical devices that use current-driven light emitting elements other than organic EL elements.

SUMMARY OF THE INVENTION

An object of the present invention is to provide a technology for setting the light emission tone of a current-driven light emitting element using a method different from the methods of the conventional art.

According to an aspect of the invention, there is provided an electrooptical device that is driven using the active matrix driving method. The electrooptical device comprises a pixel circuit matrix including a plurality of pixel circuits arranged in a matrix fashion, where each pixel circuit includes a light emitting element; a plurality of scan lines that are respectively connected to pixel circuit rows aligned in a row direction of the pixel circuit matrix; a plurality of data lines that are respectively connected to pixel circuit columns aligned in a column direction of the pixel circuit matrix; a scan line driving circuit, connected to the plurality of scan lines, for selecting one row of the pixel circuit matrix; and a data signal generating circuit that can generate a data signal corresponding to a tone of light emission from the light emitting element and output the data signal to at least one of the plurality of data lines. The data signal generating circuit includes a current generating circuit that generates a current signal output to the data line as a first data signal and a voltage generating circuit that generates a voltage signal output to the data line as a second data signal. Each pixel circuit includes: a current programming circuit that adjusts the tone of the light emission from the light emitting element based on a current value of the current signal. The current programming circuit includes: (i) the light emitting element of a current-driven type; (ii) a drive transistor disposed in a current path along which current travels to the light emitting element; (iii) a holding capacitor, connected to a control electrode of the drive transistor, for setting a value of the current that is to flow through the drive transistor by maintaining a charge in accordance with the current value of the current signal supplied from the current generating circuit; and (iv) a first switching transistor, connected between the holding capacitor and the data line, for controlling whether or not the holding capacitor should be charged using the current signal. The current programming circuit further includes a second switching transistor, connected to the holding capacitor, for controlling whether or not the holding capacitor should be charged using the voltage signal supplied by the voltage generating circuit.

Using this type of electrooptical device, voltage programming can be performed through the supply of the voltage signal to the holding capacitor via the second switching transistor, and current programming can subsequently be performed through the supply of the current signal to the holding capacitor via the first switching transistor. As a result, light emission tone setting can be performed with accuracy and at a relatively high speed.

The present invention is also directed to a driving method for an electrooptical device including the steps of: (a) charging the holding capacitor by supplying a voltage signal to the holding capacitor, and (b) causing the holding capacitor to maintain a charge commensurate with a tone of light emission from the light emitting element using a current signal having a current value that matches the tone of the light emission at least after completion of the charging using the voltage signal.

According to another aspect of the present invention, the driving method includes the steps of: (a) charging or discharging both the holding capacitor and the data line by supplying a voltage signal to the holding capacitor via the data line, and (b) causing the holding capacitor to maintain a charge commensurate with a tone of light emission from the light emitting element using a current signal having a current value that matches the tone of the light emission at least after completion of the supply of the voltage signal.

The present invention can be implemented in various forms. For example, it can be implemented in the form of a pixel circuit, an electrooptical device or display device that uses such pixel circuits, an electronic device or electronic mechanism that includes such electrooptical device or display device, a driving method for such device or mechanism, a computer program that implements the functions of such method, a recording medium on which such computer program is recorded, or data signals that include such computer program and are embodied in a carrier wave.

These and other objects, features, aspects, and advantages of the present invention will become more apparent from the following detailed description of the preferred embodiments with the accompanying drawings.

DESCRIPTION OF THE PREFERRED EMBODIMENT

Embodiments of the present invention will be described below in the following order.

A. First embodiment

B. Second embodiment

C. Third embodiment

D. Fourth embodiment

E. Fifth embodiment

F. Other variations

A. First Embodiment

Figure 1:
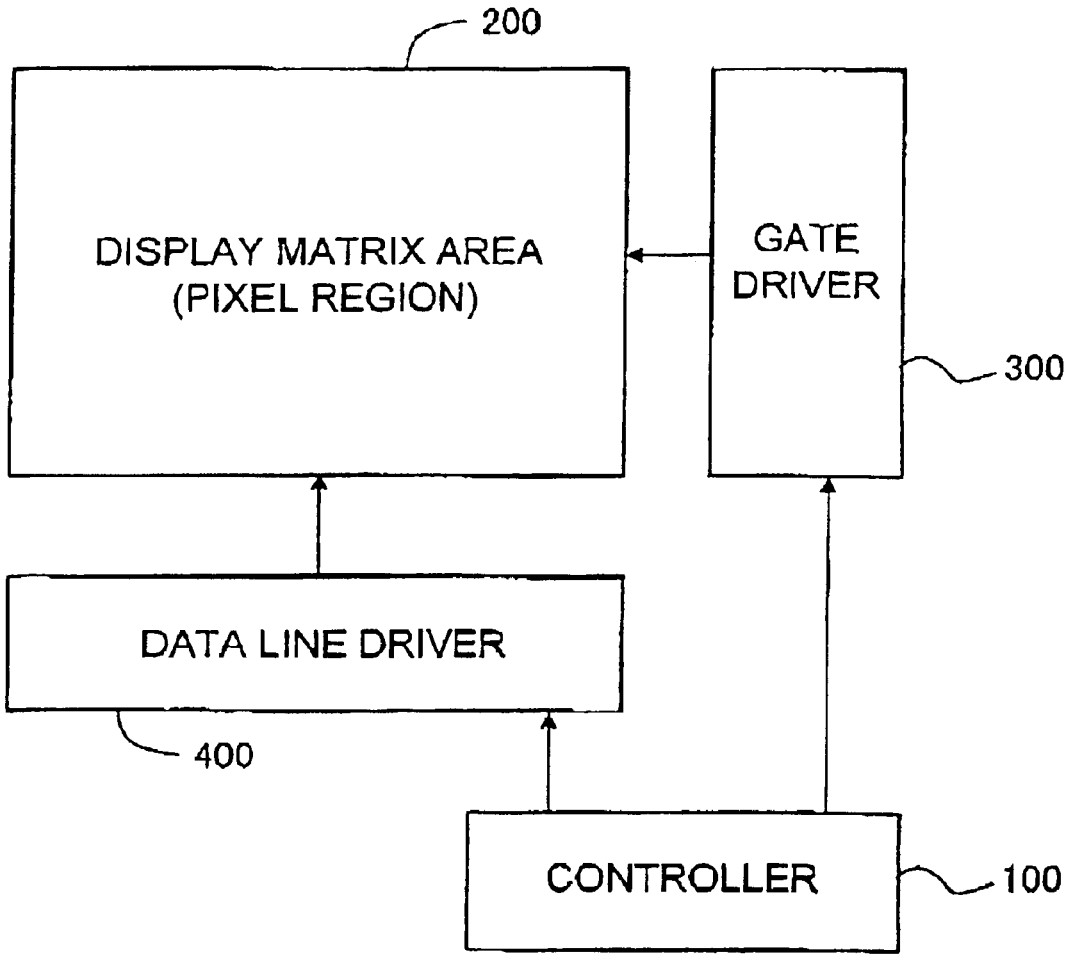
FIG. 1 is a block diagram showing the basic construction of a display device constituting a first embodiment of the present invention.

FIG. 1 is a block diagram showing the basic construction of a display device that comprises a first embodiment of the present invention. This display device has a controller 100, a display matrix area 200 (also termed the "pixel region"), a gate driver 300 and a data line driver 400. The controller 100 generates gate line drive signals and data line drive signals to enable display in the display matrix area 200, and supplies the signals to the gate driver 300 and the data line driver 400, respectively.

Figure 2:
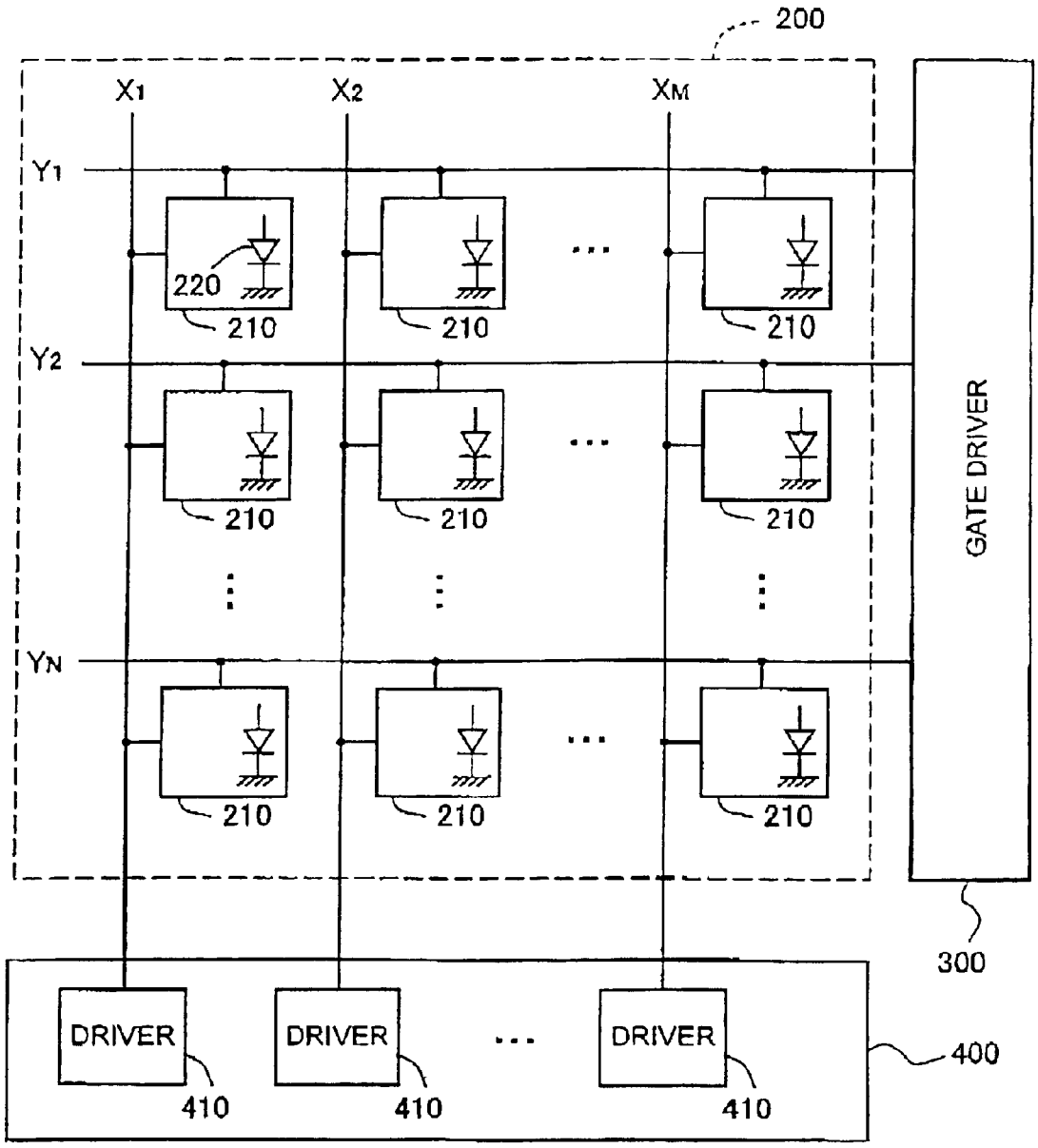
FIG. 2 is a block diagram showing the internal constructions of a display matrix area 200 and a data line driver 400.

FIG. 2 shows the internal constructions of the display matrix area 200 and the data line driver 400. The display matrix area 200 has a plurality of pixel circuits 210 arranged in a matrix fashion, and each pixel circuit 210 has an organic EL element 220. A plurality of data lines Xm (m is an integer ranging from 1 to M) that extend in the column direction and a plurality of gate lines Yn (n is an integer ranging from 1 to N) that extend in the row direction are connected to the matrix of the pixel circuits 210. The data lines are also termed "source lines", while the gate lines are also termed "scan lines". In this specification, the pixel circuits 210 are also termed "unit circuits" or simply "pixels". The transistors in the pixel circuits 210 are typically TFTs (thin film transistors).

The gate driver 300 selectively drives one of the plurality of gate lines Yn and selects one row of pixel circuits. The data line driver 400 has a plurality of single-line drivers 400 that individually drive the data lines Xm. These single-line drivers 410 supply data signals to the pixel circuits 210 over the data lines Xm. When the internal state (to be described below) of each pixel circuit 210 is set via these data signals, the value of the current flowing to each organic EL element 220 is controlled based on such setting, and as a result, the tone of the light emission from each organic EL element is controlled.

Figure 3:
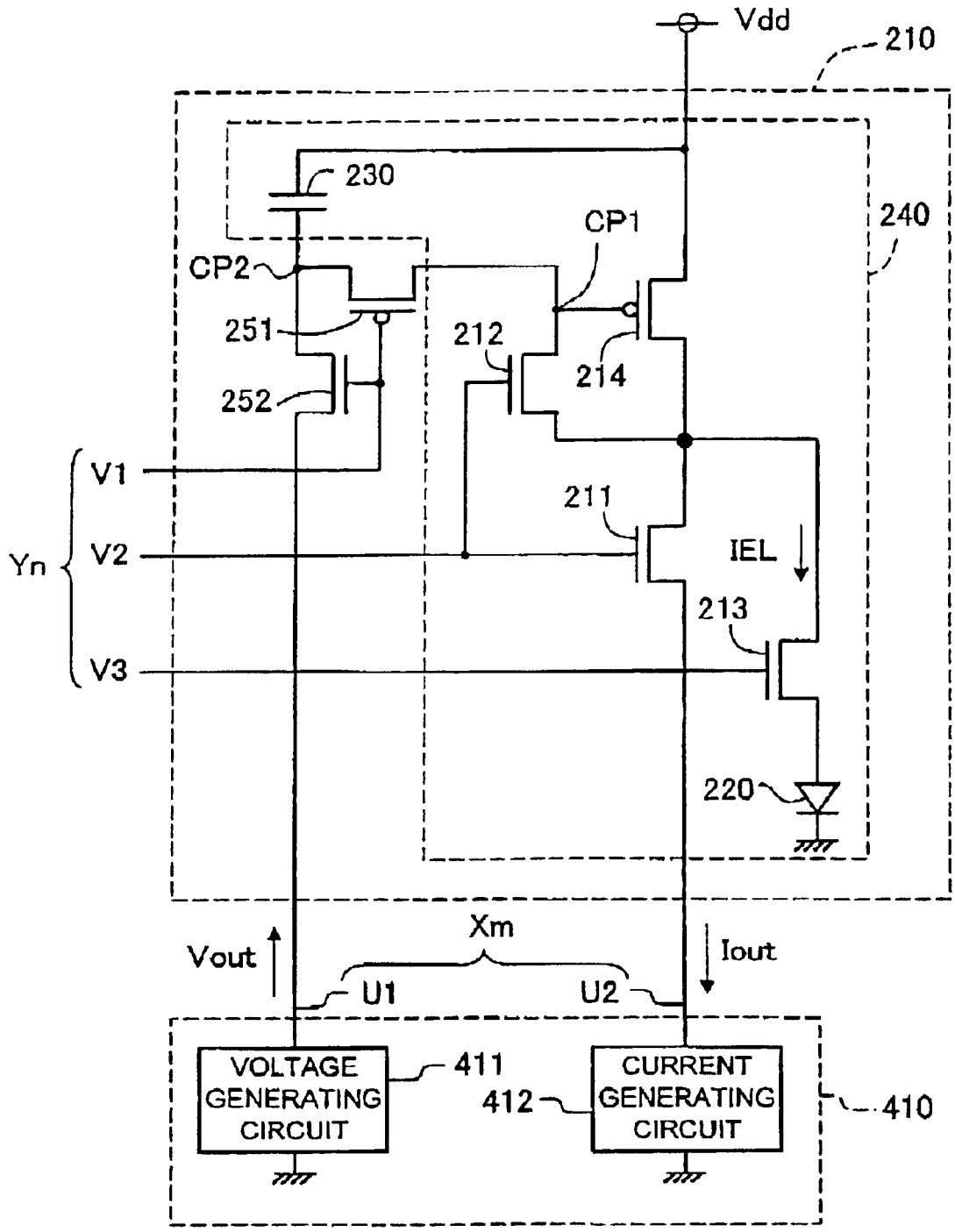
FIG. 3 is a circuit diagram showing the internal constructions of a pixel circuit 210 and a single-line driver 410 of the first embodiment.

FIG. 3 is a circuit diagram showing the internal constructions of a pixel circuit 210 and a single-line driver 410 of a first embodiment. This pixel circuit 210 is disposed at the intersection of an $m^{th}$ data line Xm and an $n^{th}$ gate line Yn. One data line Xm includes two sub-data lines U1 and U2, and one gate line Yn includes three sub-gate lines V1–V3.

The single-line driver 410 has a voltage generating circuit 411 and a current generating circuit 412. The voltage generating circuit 411 supplies voltage signals Vout to the pixel circuit 210 via the first sub-data line U1. The current generating circuit 412 supplies current signals Iout to the pixel circuit 210 via the second sub-data line U2.

The pixel circuit 210 includes a current programming circuit 240, and two additional switching transistors 251 and 252. The current programming circuit 240 is a circuit that adjusts the tone of the organic EL element 220 based on the value of the current flowing in the second sub-data line U2.

Figure 4:
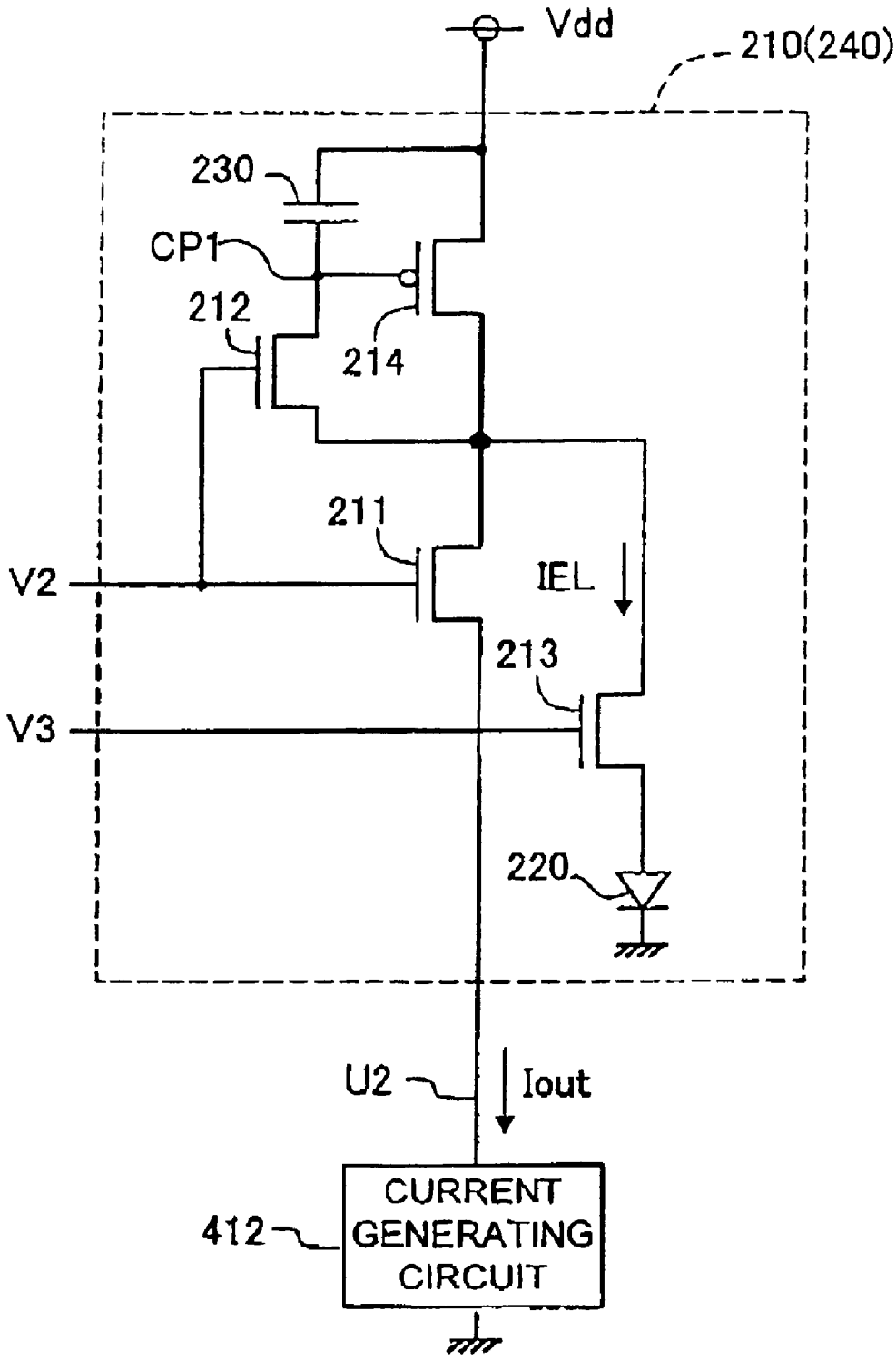
FIG. 4 is a circuit diagram of an equivalent circuit to the pixel circuit 210 where the transistor 251 is in the ON state and the transistor 252 is in the OFF state.

FIG. 4 shows an equivalent circuit to the pixel circuit 210 where the transistor 251 is in the ON state and the other transistor 252 is in the OFF state (that is, an equivalent circuit to the current programming circuit 240). The current programming circuit 240 has, in addition to the organic EL element 220, four transistors 221–224 and a holding capacitor (also termed a "holding condenser" or a "storage capacitor") 230. The holding capacitor 230 maintains an electric charge commensurate with the current value of the current signal Iout supplied thereto via the second sub-data line U2, and thereby adjusts the tone of the light emission from the organic EL element 220. In this example, the first through third transistors 211–213 are n-channel FETs, while the fourth transistor 214 is a p-channel FET. Because the organic EL element 220 is a current infusion (current-driven) type light-emitting element similar to a photodiode, it is expressed in the figure using a diode symbol.

The drain of the first transistor 211 is connected to the source of the second transistor 212, the drain of the third transistor 213 and the drain of the fourth transistor 214. The drain of the second transistor 212 is connected to the gate of the fourth transistor 214. The holding capacitor 230 is connected to a node between the source and the gate of the fourth transistor 214. The source of the fourth transistor 214 is also connected to a power supply potential Vdd. The source of the first transistor 212 is connected to the current generating circuit 412 via the second sub-data line U2. The organic EL element 220 is connected between the source of the third transistor 213 and a ground potential. The gates of the first and second transistors 211 and 212 are both connected to the second sub-gate line V2. The gate of the third transistor 213 is connected to the third sub-gate line V3.

The first and second transistors 211 and 212 are switching transistors used when a charge is being accumulated in the holding capacitor 230 via the second sub-data line U2. The third transistor 213 is a switching transistor that is maintained in the ON state during light emission from the organic EL element 220. The fourth transistor 214 is a drive transistor that regulates the value of the current flowing to the organic EL element 220. The value of the current flowing to the fourth transistor 214 is regulated by the amount of charge (amount of accumulated charge) held by the holding capacitor 230.

The pixel circuit 210 shown in FIG. 3 differs from the equivalent circuit shown in FIG. 4 in the following respects:

(1) A switching transistor 251 is added between the holding capacitor 230 and the connection point CP1 which connects the drain of the second transistor 212 and the gate of the fourth transistor (see FIG. 4).

(2) Another switching transistor 252 is added between the first sub-data line U1 and the connection point CP2 which connects the holding capacitor 230 and the switching transistor 251.

(3) A sub-gate line V1 is added that is commonly connected to the gates of the added transistors 251 and 252.

(4) Voltage signals Vout can be supplied from the voltage generating circuit 411 to the holding capacitor 230 via the first sub-data line U1, and current signals Iout can be supplied from the current generating circuit 412 to the holding capacitor 230 via the second sub-data line U2.

In the discussion below, the added transistors 251 and 252 are termed "voltage programming transistors 251 and 252." In the example shown in FIG. 3, the first voltage programming transistor 251 is a p-channel FET, while the second voltage programming transistor 252 is an n-channel FET.

The first and second transistors 211 and 212 of the current programming circuit 240 have the function of controlling whether or not the holding capacitor 230 should be charged using the current signal Iout, or the function of defining a current programming period. They correspond to the "first switching transistor" in the present invention. The second voltage programming transistor 252 has the function of controlling whether or not the holding capacitor 230 should be charged using the voltage signal Vout, or the function of defining a voltage programming period. The transistor 252 corresponds to the "second switching transistor" in the present invention. The first voltage programming transistor 251 corresponds to the "third switching transistor" in the present invention. The first voltage programming transistor 251 may be omitted, however.

Figure 5:
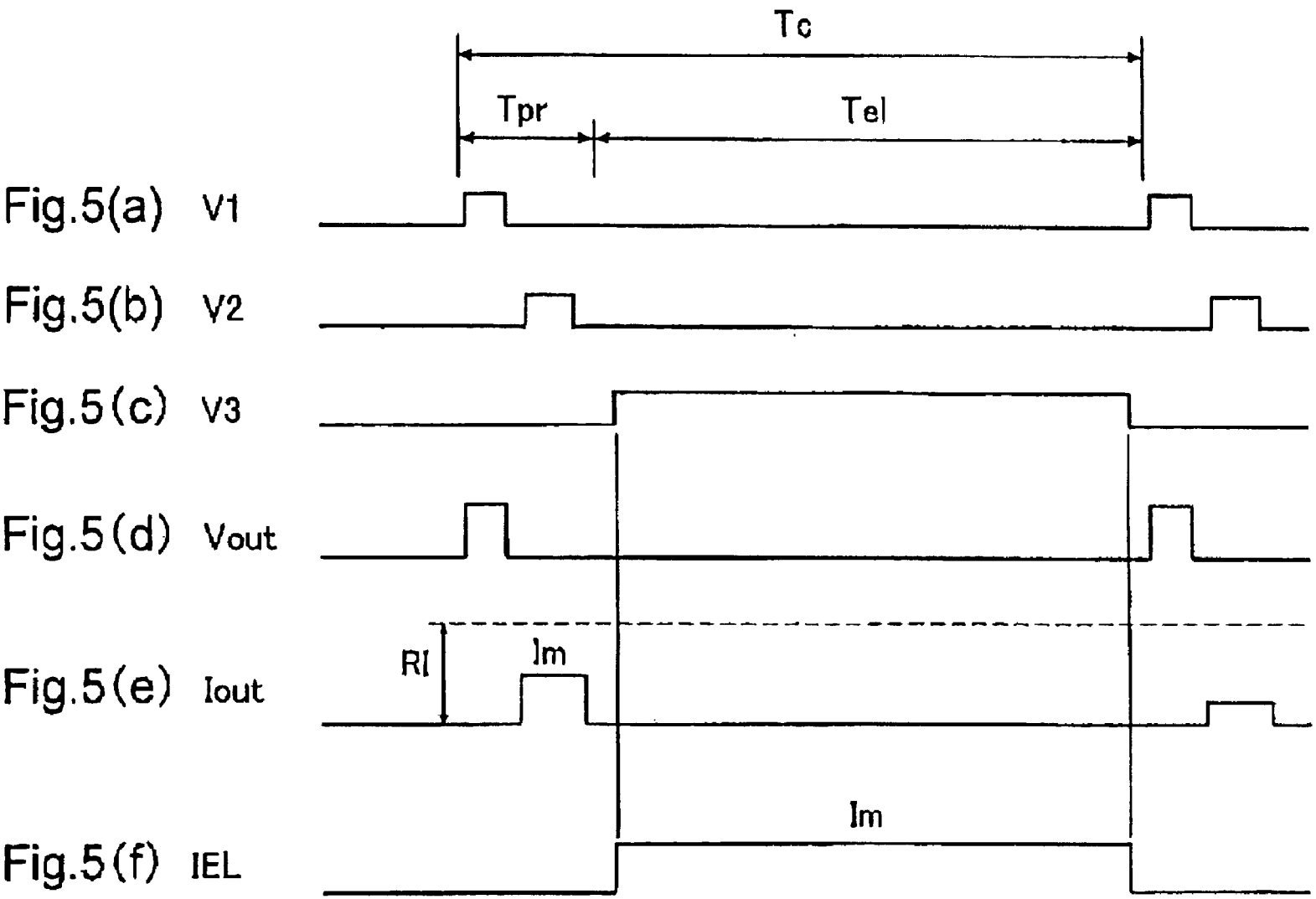
FIGS. 5(*a*)–5(*f*) are timing charts showing the normal operation of the pixel circuit 210 of the first embodiment.

FIGS. 5(*a*)–5(*f*) are timing charts showing the operation of the pixel circuit 210, and show the voltage values of the sub-gate lines V1–V3 (termed "gate signals V1–V3" below), the current value Iout of the second sub-data line U2, and the value of the current IEL that flows to the organic EL element 220.

The drive period Tc is divided into a programming period Tpr and a light emission period Tel. The "drive period Tc" is the period during which the tone of the light emission is refreshed for all organic EL elements 220 in the display matrix area 200, and is identical to the so-called frame period. Tone refresh is carried out for each row of pixel circuits, and is sequentially executed for the N rows of pixel circuits during the drive period Tc. For example, where the tone of all pixel circuits is refreshed at a frequency of 30 Hz, the drive period Tc is approximately 33 ms.

The programming period Tpr is the period during which the tone of light emission from the organic EL element 220 is set in the pixel circuit 210. In this specification, the setting of the tone in the pixel circuit 210 is termed "programming". For example, where the drive cycle Tc is 33 ms and the total number N of gate lines Yn (i.e., the number of rows in the pixel circuit matrix) is 480, the programming period Tpr is no more than about 69 $\mu$s (=33 ms/480).

During the programming period Tpr, the second and third gate signals V2 and V3 are initially set to L level to maintain the first and third transistors 211 and 213 in the OFF state. The first gate signal V1 is then set to H level to set the first voltage programming transistor 251 to the OFF state and the second voltage programming transistor 252 to the ON state. The voltage generating circuit 411 (FIG. 3) then generates a voltage signal Vout having a voltage value that corresponds to the light emission tone. However, a signal having a fixed voltage value irrespective of the light emission tone may be used as the voltage signal Vout. When this voltage signal Vout is supplied to the holding capacitor 230 via the second programming transistor 252, charge corresponding to the voltage signal Vout is accumulated in the holding capacitor 230.

When programming via the voltage signal Vout as described above has ended, the first gate signal V1 is lowered to L level to set the first voltage programming transistor 251 to the ON state and the second voltage programming transistor 252 to the OFF state. When this is done, the pixel circuit 210 becomes the equivalent circuit shown in FIG. 4. In this state, the second gate signal V2 is set to H level to set the first and second transistors 211 and 212 to the ON state while a current value Im corresponding to the light emission tone is sent to the second sub-data line U2 (FIGS. 5(*b*), 5(*e*)). The current generating circuit 412 (FIG. 3) functions as a fixed-current source that supplies a fixed current value Im corresponding to the light emission tone. As shown in FIG. 5(*e*), this current value Im is set to a value corresponding to the tone of the light to be emitted from the organic EL element 220 within a predetermined current value range RI.

As a result of the programming executed using the current value Im, the holding capacitor 230 enters a state in which it maintains a charge corresponding to the current value Im flowing through the fourth transistor (drive transistor) 214. In this state, the voltage stored in the holding capacitor 230 is applied between the source and the gate of the fourth transistor 214. In this specification, the current value Im of the data signal Iout used for programming is termed the "programming current value Im."

When the programming executed using the current signal Iout is completed, the gate driver 300 sets the second gate signal V2 to L level to set the first and second transistors 211 and 212 to the OFF state, and the current generating circuit 412 stops the current signal Iout.

During the light emission period Tel, the first gate signal V1 is maintained at L level to set the pixel circuit 210 to the equivalent circuit state shown in FIG. 4. In addition, while the second gate signal V2 is maintained at L level to keep the first and second transistors in the OFF state, the third gate signal V3 is set to H level to set the third transistor 213 to the ON state. Because the voltage corresponding to the programming current value Im is stored in advance in the holding capacitor 230, a current that is essentially equivalent to the programming current value Im flows to the fourth transistor 214. Therefore, a current that is essentially equivalent to the programming current value Im also flows to the organic EL element 220, which emits light having a tone corresponding to this current value Im.

Because the pixel circuit 210 of the first embodiment executes programming via a current signal Iout after execution of programming via a voltage signal Vout, as described above, the light emission tone can be set more accurately than it can via programming using a voltage signal Vout only. Furthermore, the light emission tone can be set more quickly than it can when programming via a current signal Iout only is executed. In other words, the pixel circuit 210 enables the light emission tone to be set more quickly and more accurately than in the conventional art.

B. Second Embodiment

Figure 6:
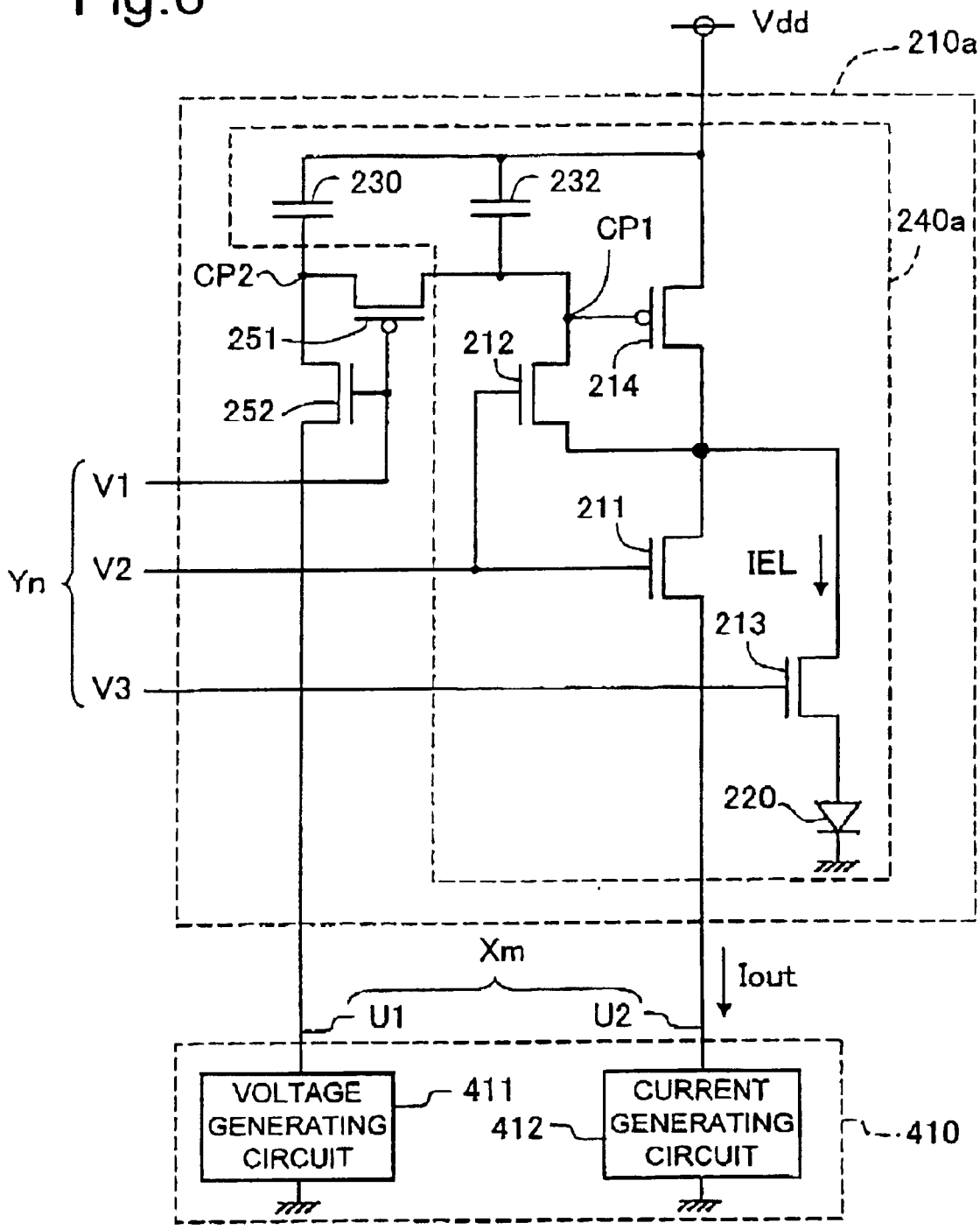
FIG. 6 is a circuit diagram showing the internal constructions of a pixel circuit 210*a* and a single-line driver 410 of a second embodiment.

FIG. 6 is a circuit diagram showing the internal constructions of a pixel circuit 210*a* and a single-line driver 410 of a second embodiment. Except for the addition of a second holding capacitor 232, the construction of the pixel circuit 210*a* is identical to that of the pixel circuit 210 of the first embodiment. The second holding capacitor 232 is disposed between the power supply Vdd and the connection point CP1 which connects the drain of the second transistor 212 and the gate of the fourth transistor.

Figure 7:
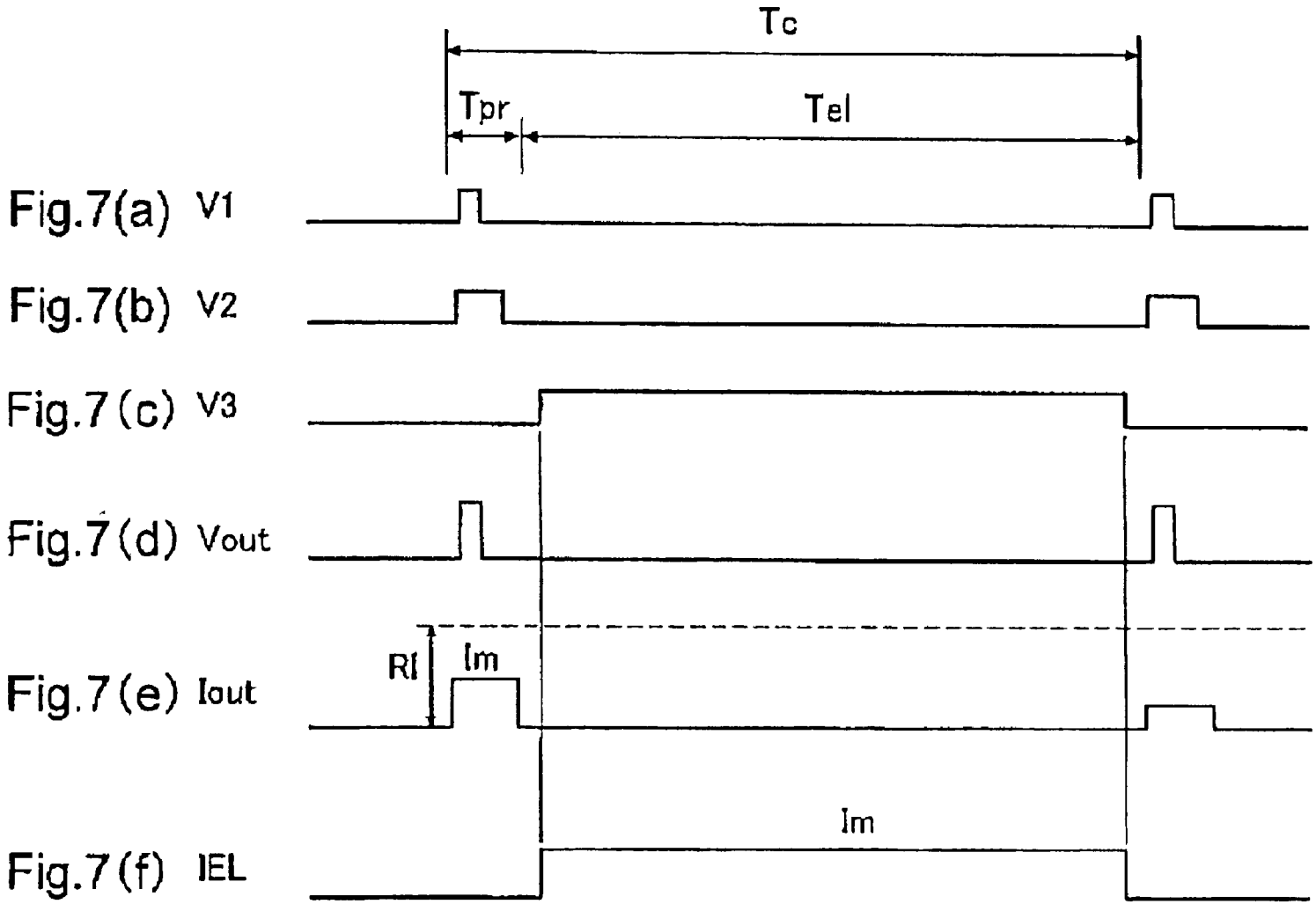
FIGS. 7(*a*)–7(*f*) are timing charts showing the operation of the pixel circuit 210*a* of the second embodiment.

FIGS. 7(*a*)–7(*f*) are timing charts showing the operation of the pixel circuit 210*a* of the second embodiment. In the second embodiment, a period during which the first gate signal V1 and the second gate signal V2 are both at H level exists during the programming period Tpr. While the first gate signal V1 is at H level, the second voltage programming transistor 252 is in the ON state and programming of the first holding capacitor 230 is executed via the voltage signal Vout. While the second gate signal V2 is at H level, the first and second switching transistors 211 and 212 incorporated in the current programming circuit 240 are in the ON state and programming of the second holding capacitor 232 is executed via the current signal Iout. While both the first and second gate signals V1 and V2 are at H level, because the first voltage programming transistor 251 is maintained in the OFF state, the voltage programming of the first holding capacitor 230 and the current programming of the second holding capacitor 232 are executed in a parallel fashion.

Thereafter, when the first gate signal V1 falls to L level before the second gate signal V2, voltage programming is completed, and programming (current programming) of the two holding capacitors 230 and 232 is continued. When this is done, because the first holding capacitor 230 is programmed in advance using voltage, the amount of time necessary in order to maintain an appropriate charge amount in the two holding capacitors 230 and 232 can be reduced.

As can be understood from the second embodiment, programming via the voltage signal Vout may be executed simultaneously with programming via the current signal Iout. The light emission tone can be set more accurately if current programming is completed after the completion of voltage programming, as shown in FIGS. 7(*a*)–7(*f*). In other words, it is preferred that current programming be executed at least after voltage programming has ended.

C. Third Embodiment

Figure 8:
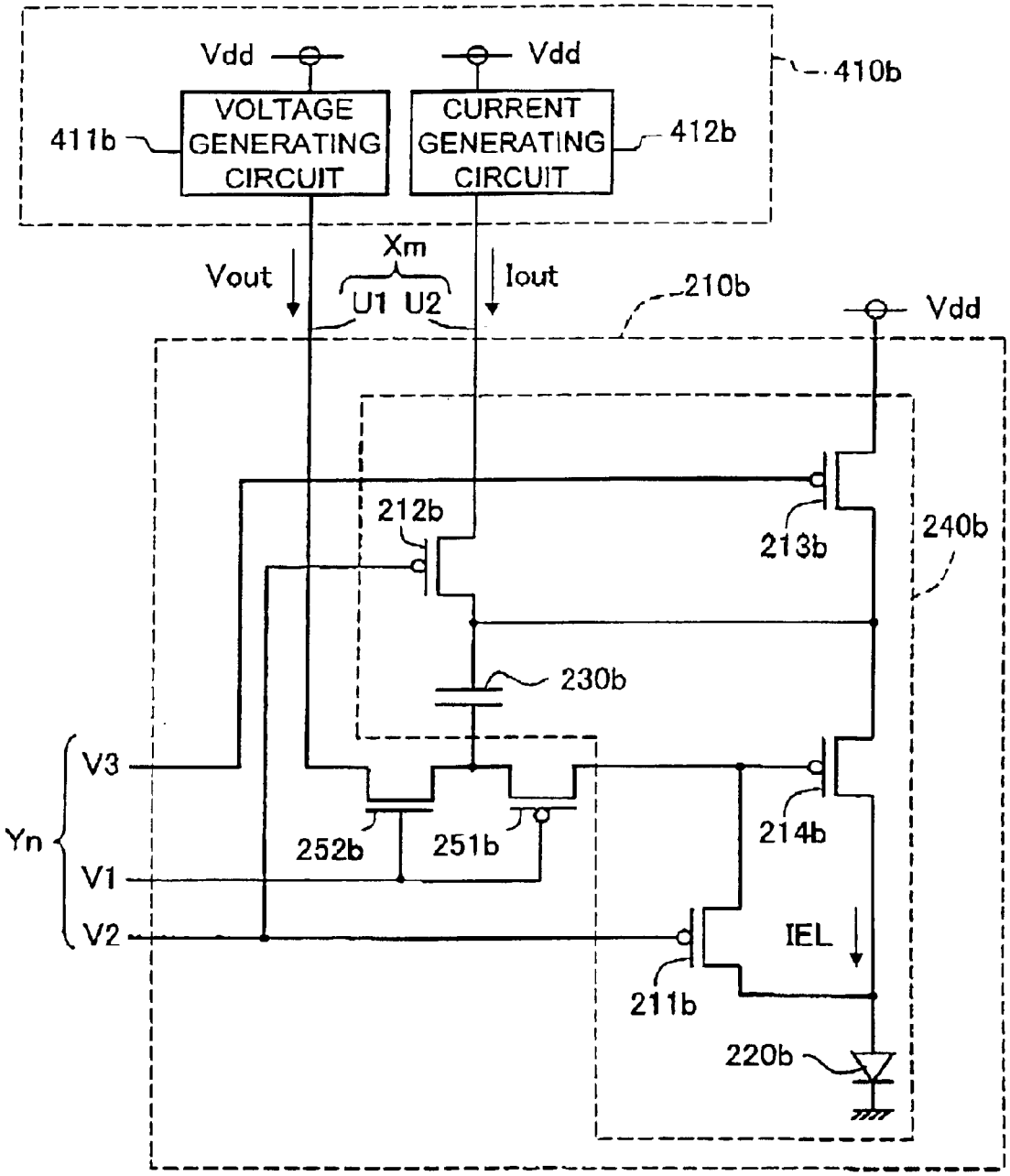
FIG. 8 is a circuit diagram showing the internal constructions of a pixel circuit 210*b* and a single-line driver 410*b* of a third embodiment.

FIG. 8 is a circuit diagram showing the internal constructions of a pixel circuit 210*b* and a single-line driver 410*b* of a third embodiment. The voltage generating circuit 411*b* and the current generating circuit 412*b* of this single-line driver 410*b* are connected to the power supply potential Vdd.

The pixel circuit 210*b* of the third embodiment includes a so-called Sarnoff current programming circuit 240*b* and two voltage programming transistors 251*b* and 252*b*. The current programming circuit 240*b* has an organic EL element 220*b*, four transistors 211*b*–214*b*, and a holding capacitor 230*b*. The four transistors 211*b*–214*b* in this embodiment are p-channel FETs.

The second transistor 212*b*, the holding capacitor 230*b*, the first voltage programming transistor 251*b*, the first transistor 211*b* and the organic EL element 220*b* are serially connected to the second sub-data line U2 in the order described. The drain of the first transistor 211*b* is connected to the organic EL element 220*b*. The second sub-gate line V2 is commonly connected to the gates of the first and second transistors 211*b* and 212*b*.

The third transistor 213*b*, the fourth transistor 214*b* and the organic EL element 220*b* are serially connected between the power supply potential Vdd and a ground potential. The drain of the third transistor 213*b* and the source of the fourth transistor 214*b* are also connected to the drain of the second transistor 212*b*. The third gate line V3 is connected to the gate of the third transistor 213, and the gate of the fourth transistor 214*b* is connected to the source of the first transistor 211*b*.

The holding capacitor 230*b* and the first voltage programming transistor 251*b* are serially connected between the source and the gate of the fourth transistor 214*b*. Because the first voltage programming transistor 251*b* is maintained in the ON state during light emission from the organic EL element 220*b*, the voltage between the source and the gate of the fourth transistor 214*b* is determined in accordance with the amount of charge accumulated in the holding capacitor 230*b*.

The first and second transistors 211*b* and 212*b* are switching transistors used when a desired amount of charge is to be accumulated in the holding capacitor 230*b*. The third transistor 213*b* is a switching transistor that is maintained in the ON state during light emission from the organic EL element 220*b*. The fourth transistor 214*b* is a drive transistor that regulates the value of the current flowing to the organic EL element 220*b*.

The first and second transistors 211*b* and 212*b* of the current programming circuit 240*b* have the function of controlling whether or not the holding capacitor 230*b* should be charged with the current signal Iout, or the function of defining a current programming period. These transistors 211*b*, 212*b* are equivalent to the "first switching transistor" in the present invention. Similarly, the second voltage programming transistor 252*b* has the function of controlling whether or not the holding capacitor 230*b* should be charged with the voltage signal Vout, or the function of defining a voltage programming period. This transistor 252*b* is equivalent to the "second switching transistor" in the present invention. Furthermore, the first voltage programming transistor 251*b* is equivalent to the "third switching transistor" in the present invention. The first voltage programming transistor 251*b* may be omitted, however.

Figure 9:
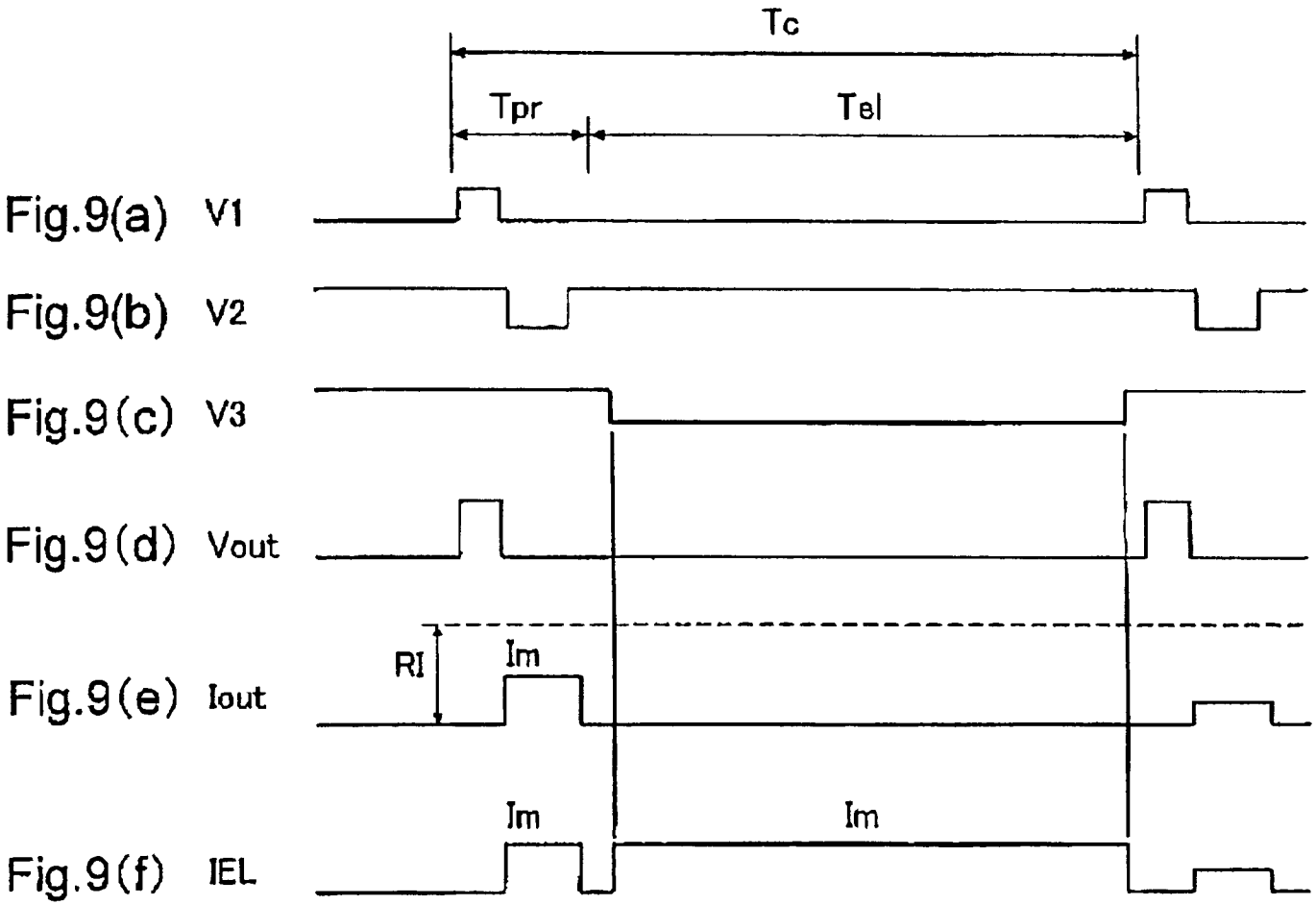
FIGS. 9(*a*)–9(*f*) are timing charts showing the operation of the pixel circuit 210*b* of the third embodiment.

FIGS. 9(*a*)–9(*f*) are timing charts showing the operation of the pixel circuit 210*b* of the third embodiment. In this operation, the logic of the second and third gate signals V2 and V3 is reversed in relation to the operation of the first embodiment shown in FIGS. 5(*b*) and 5(*c*). In addition, in the third embodiment, the programming current Im flows to the organic EL element 220*b* via the second and fourth transistors 212*b* and 214*b* during the programming period Tpr, as can be seen from the circuit construction shown in FIG. 8. Therefore, in the third embodiment, light is emitted from the organic EL element 220*b* during the programming period Tpr as well. As described above, light may be emitted from the organic EL element during the programming period Tpr, or alternatively, light need not be emitted during this period, as in the first and second embodiments.

The third embodiment has the same effect as the first and second embodiments. In other words, because both voltage programming and current programming are carried out, the light emission tone can be set more accurately than if only voltage programming is performed. Furthermore, the light emission tone can be set more quickly than if only current programming is carried out.

D. Fourth Embodiment

Figure 10:
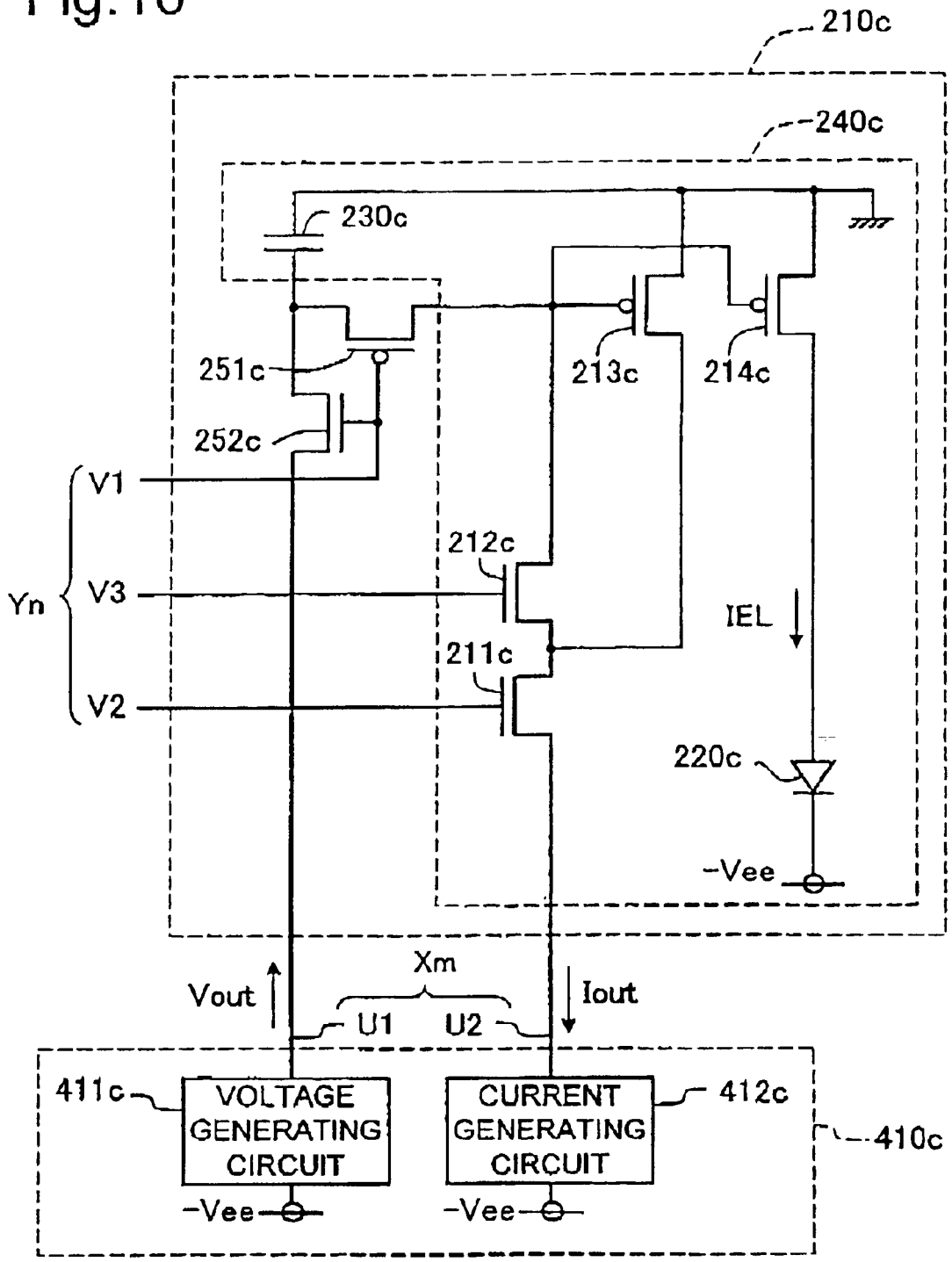
FIG. 10 is a circuit diagram showing the internal constructions of a pixel circuit 210*c* and a single-line driver 410*c* of a fourth embodiment.

FIG. 10 is a circuit diagram showing the internal constructions of a pixel circuit 210*c* and a single-line driver 410*c* of a fourth embodiment. The voltage generating circuit 411*c* and the current generating circuit 412*c* incorporated in the single-line driver 410*c* are each connected to a negative polarity power supply potential −Vee.

The pixel circuit 210*c* of the fourth embodiment includes a current programming circuit 240*c* and two voltage programming transistors and 252*c*. The current programming circuit 240*c* has an organic EL element 220*c*, four transistors 211*c*–214*c*, and a holding capacitor 230*c*. In this example, the first and second transistors 211*c* and 212*c* are n-channel FETs, and the third and fourth transistors 213*c* and 214*c* are p-channel FETs.

The first and second transistors 211*c* and 212*c* are serially connected to the second sub-data line U2 in that order. The drain of the second transistor 212*c* is connected to the gates of the third and fourth transistors 213*c* and 214*c*. In addition, the drain of the first transistor 211*c* and the source of the second transistor 212*c* are connected to the drain of the third transistor 213*c*. The drain of the fourth transistor 214*c* is connected to the power supply potential −Vee via the organic EL element 220*b*. The sources of the third and fourth transistors 213*c* and 214*c* are grounded. The first voltage programming transistor 251*c* and the holding capacitor 230*c* are serially connected between the gate and the source of the third and fourth transistors 213*c* and 214*c*. When the first voltage programming transistor 251*c* is in the ON state, the holding capacitors 230*c* sets the voltage between the source and the gate of the fourth transistor 214*c*, which is the drive transistor for the organic EL element 220*c*. Therefore, the tone of light emission from the organic EL element 220*c* is determined in accordance with the amount of charge accumulated in the holding capacitor 230*c*. The second voltage programming transistor 252*c* is connected between one terminal of the holding capacitor 230*c* and the first sub-data line U1.

The first sub-gate line V1 is commonly connected to the gates of the two voltage programming transistors 251*c* and 252*c*. The second and third sub-gate lines V2 and V3 are respectively connected to the gates of the first and second transistors 211*c* and 212*c*.

The first and second transistors 211*c* and 212*c* are transistors used when a desired amount of charge is to be accumulated in the holding capacitor 230*c*. The fourth transistor 214*c* is a drive transistor used to control the value of the current flowing to the organic EL element 220*c*. The third and fourth transistors 213*c* and 214*c* constitute a so-called current mirror circuit, and the value of the current flowing to the third transistor 213*c* and the value of the current flowing to the fourth transistor 214*c* have a prescribed proportional relationship. Therefore, when a programming current Im is supplied to the third transistor 213*c* via the second sub-data line U2, a current proportional to this current flows to the fourth transistor 214*c* and the organic EL element 220*c*. The ratio between these two current values is equivalent to the ratio between the gain factors β of the two transistors 213*c* and 214*c*. As is well known, the gain factor β is defined as $\beta=(\mu C_0 W/L)$. Here, $\mu$ is the mobility of the carrier, $C_0$ is the gate capacity, W is the channel width, and L is the channel length.

The first and second transistors 211*c* and 212*c* of the current programming circuit 240*c* have the function of controlling whether or not the holding capacitor 230*c* should be charged via the current signal Iout, or the function of defining a current programming period. These transistors 211*c*, 212*c* are equivalent to the "first switching transistor" in the present invention. Similarly, the second voltage programming transistor 252*c* has the function of controlling whether or not the holding capacitor 230*c* should be charged via the voltage signal Vout, or the function of defining a voltage programming period. This transistor 252*c* is equivalent to the "second switching transistor" in the present invention. Furthermore, the first voltage programming transistor 251*c* is equivalent to the "third switching transistor" in the present invention. The first voltage programming transistor 251*c* may be omitted, however.

Figure 11:
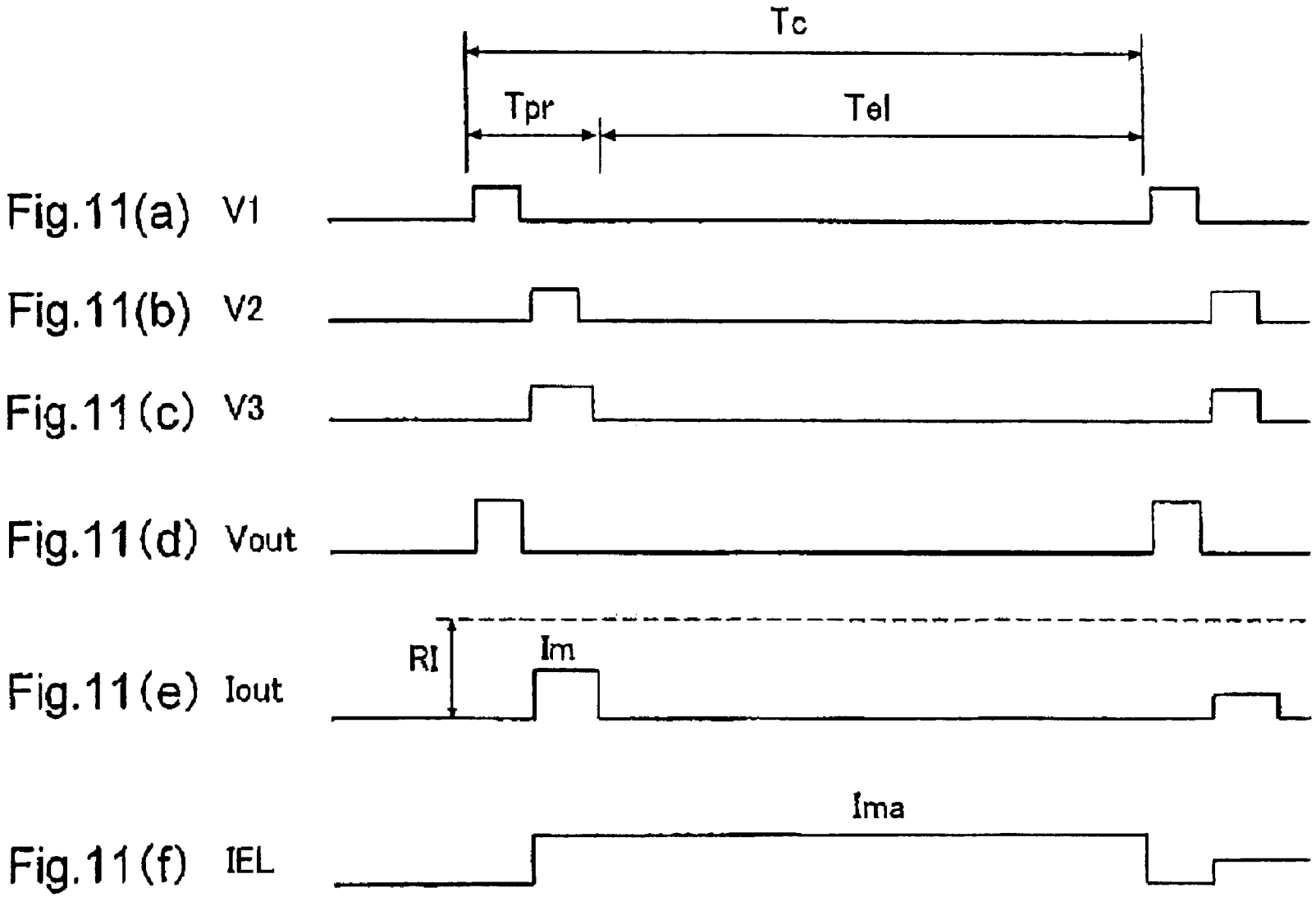
FIGS. 11(*a*)–11(*f*) are timing charts showing the operation of the pixel circuit 210*c* of the fourth embodiment.

FIGS. 11(*a*)–11(*f*) are timing charts showing the operation of the pixel circuit 210*c* of the fourth embodiment. During the programming period Tpr, only the first gate signal V1 is initially set to H level, and therefore the first and second voltage programming transistors 251*c* and 252*c* are set to the OFF and ON state, respectively. When this is done, the voltage generating circuit 411*c* executes voltage programming by supplying a voltage signal Vout to the holding capacitor 230*c* via the first sub-data line U1. Next, the first gate signal V1 falls to L level, and the second and third gate signals V2 and V3 switch to H level. While the second and third gate signals V2 and V3 are at H level, the first and second switching transistors 211*c* and 212*c* of the current programming circuit 240*c* switch to the ON state, and programming of the holding capacitor 230*c* via a current signal Iout is executed. At the same time, a current value Ima proportional to the current value Im of the current signal Iout also flows to the fourth transistor 214*c* and the organic EL element 220*c* (FIG. 11(*f*)). When this occurs, a charge corresponding to the operating state of the third and fourth transistors 213*c* and 214*c* is accumulated in the holding capacitor 230*c*. Consequently, even after the second and third gate signals V2 and V3 have fallen to L level, a current value Ima corresponding to the amount of charge accumulated in the holding capacitor 230*c* flows to the fourth transistor 214*c* and the organic EL element 220*c*.

The fourth embodiment has the same effect as the other embodiments described above. In other words, because both voltage programming and current programming are carried out, the light emission tone can be set more accurately than if only voltage programming is performed, and the light emission tone can be set more quickly than if only current programming is carried out.

E. Fifth Embodiment

Figure 12:
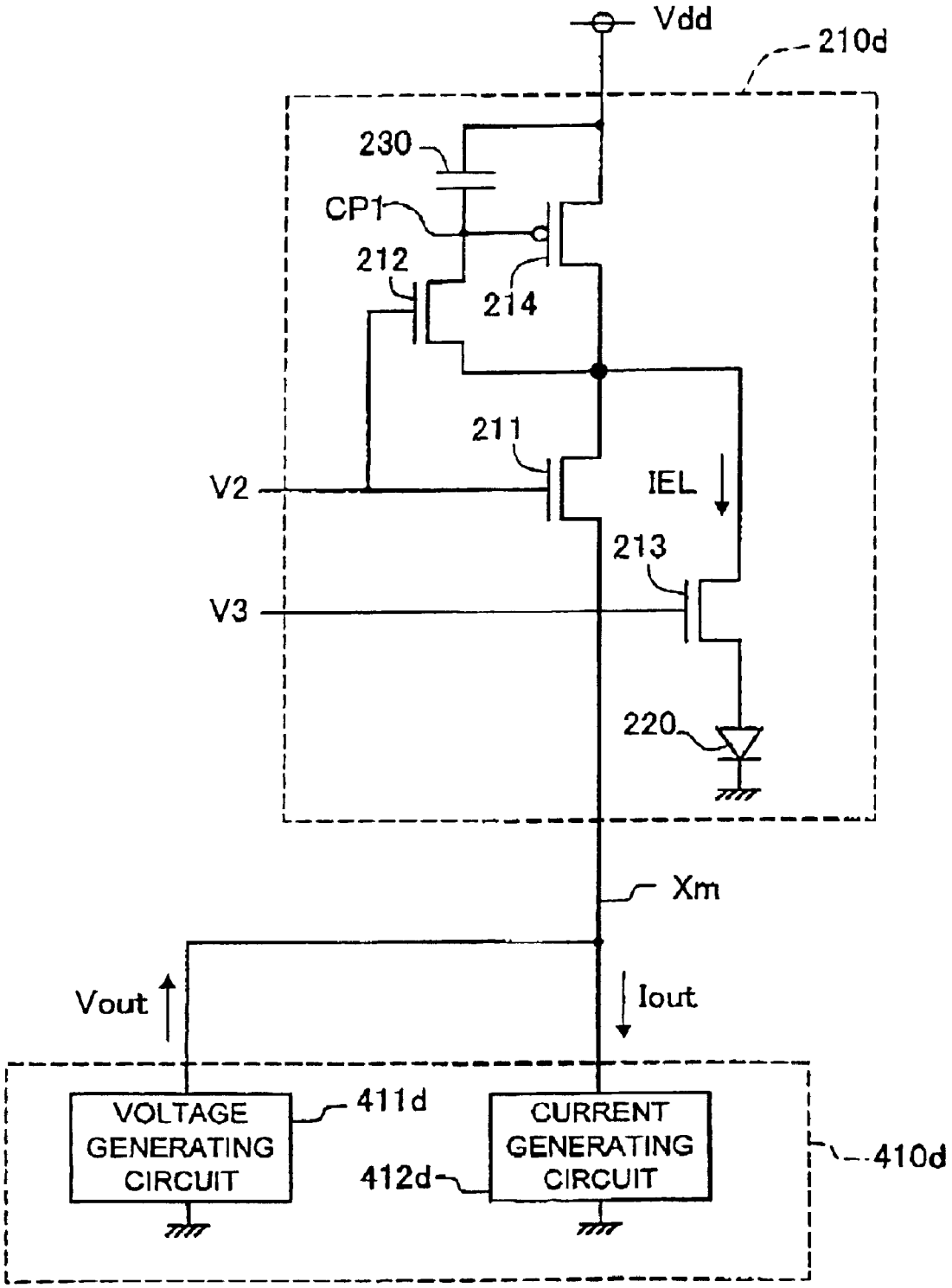
FIG. 12 is a circuit diagram showing the internal constructions of a pixel circuit 210*d* and a single-line driver 410*d* of a fifth embodiment.

FIG. 12 is a circuit diagram showing the internal constructions of a pixel circuit 210*d* and a single-line driver 410*d* of a fifth embodiment. This pixel circuit 210*d* is identical to the circuit shown in FIG. 4. In other words, the fifth embodiment does not have the two switching transistors 251 and 252 that were present in the first embodiment (see FIG. 3). Furthermore, the sub-gate line V1 used for the transistors 251 and 252 is also omitted. The single-line driver 410*d* and its internal circuits 411*d* and 412*d* are identical to the equivalent circuits in the first embodiment shown in FIG. 3. However, the fifth embodiment differs from the first embodiment in that the voltage generating circuit 411*d* and the current generating circuit 412*d* are commonly connected to the pixel circuit 210*d* via a single data signal line Xm.

Figure 13:
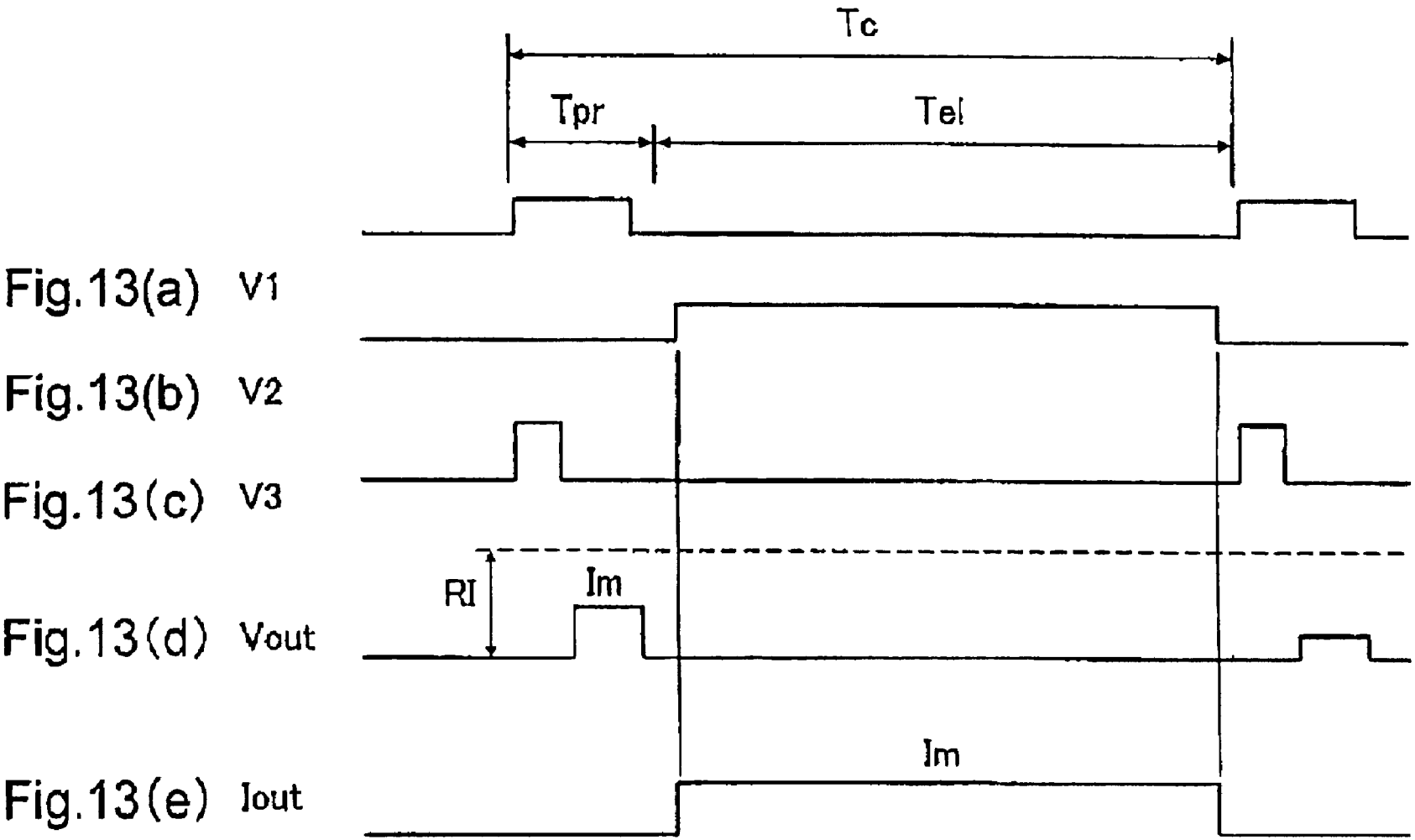
FIGS. 13(*a*)–13(*e*) are timing charts showing the operation of the pixel circuit 210*d* of the fifth embodiment.

FIGS. 13(*a*)–13(*e*) are timing charts showing the operation of the pixel circuit 210*d* of the fifth embodiment. During the first half of the programming period Tpr, voltage programming is executed through the supply of a voltage signal Vout (see FIG. 13(*c*)) from the voltage generating circuit 411*d* to the data line Xm. When this is done, the data line Xm is charged or discharged and the holding capacitor 230 is charged or discharged accordingly. During the second half of the programming period Tpr, the holding capacitor 230 is accurately programmed through the supply of a current signal Iout (FIG. 13(*d*)) from the current generating circuit 412*d*. In the fifth embodiment, because the switching transistor 211 is set to the ON state for both voltage programming and current programming, the gate signal V2 is maintained at H level in both cases.

As described above, even where a pixel circuit identical to the conventional pixel circuit is used, if both voltage programming and current programming are executed, the light emission tone can be set more accurately than if only voltage programming is performed, and can be set more quickly than if only current programming is performed. In the fifth embodiment in particular, current programming is executed after the completion of voltage programming using the same single data line Xm. During voltage programming, a kind of pre-charge is executed with respect to both the data line Xm and the holding capacitor 230, whereupon current programming is executed. Therefore, the light emission tone can be set more accurately and quickly than is possible using the pixel circuit of the conventional art.

Figure 14:
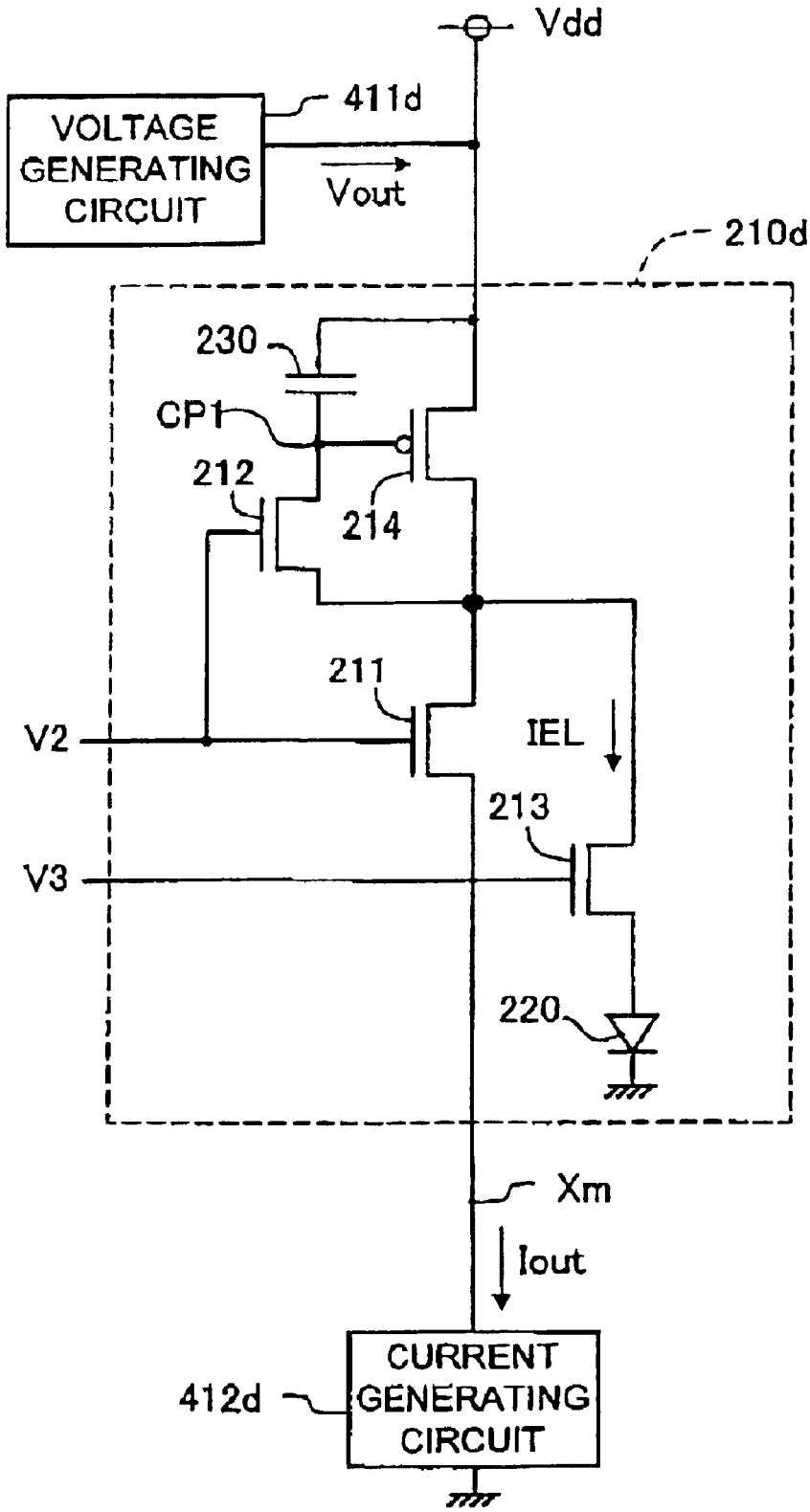
FIG. 14 is a circuit diagram showing the construction of a variation of the fifth embodiment.

FIG. 14 is a circuit diagram showing a variation of the fifth embodiment. It differs from the construction shown in FIG. 12 in that the voltage generating circuit 411*d* is disposed on the power supply voltage Vdd side. The same effect obtained with the circuit shown in FIG. 12 is obtained with this circuit as well.

Where voltage programming and current programming are carried out using the same data line Xm, as with the fifth embodiment, the voltage programming period and the current programming period may partially overlap. In order to accurately set the light emission tone, it is preferred that the timing of the voltage and current signals be adjusted such that current programming (i.e., the supply of a current signal) is executed at least in a period after voltage programming (i.e., the supply of a voltage signal) has completed.

F. Other Variations

Variation F1:

In the various embodiments:described above, programming was executed for each row of pixel circuits (i.e., in the order of pixel row lines), but programming may instead be carried out for each pixel (i.e., in the order of pixel dots). Where programming is carried out in pixel dot sequence, there is no need for a single-line driver (i.e., data signal generating circuit) 410 to exist for each data line set Xm (U1, U2), and one single-line driver 410 may be used for the entire pixel circuit matrix. In this case, the single-line driver 410 is constructed such that the data signals (i.e., the voltage signals Vout and current signals Iout) are output to the one data line set that governs the pixel circuit to be programmed. In order to realize such a construction, a switching circuit that switches among the connections between the single-line driver 410 and the plurality of data line sets is provided.

Variation F2

In the various embodiments described above, all of the transistors constituted FETs, but all or some of the transistors may instead constitute bipolar transistors or other types of switching elements. The gate electrode of an FET and the base electrode of a bipolar transistor are equivalent to the "control electrode" in the present invention. The various types of transistors described above may be silicon base transistors instead of thin film transistors (TFT).

Variation F3

In the pixel circuit in the various embodiments described above, the programming period Tpr and the light emission period Tel did not overlap, but pixel circuits in which the programming period Tpr and the light emission period Tel partially overlap may be used instead. For example, during the operations shown in FIGS. 9(*a*)–9(*f*) and FIGS. 11(*a*)–11(*f*), the current IEL is flowing to the organic EL element even during the programming period Tpr, thereby triggering light emission. Therefore, a partial overlap of the programming period Tpr and the light emission period Tel may be deemed to exist in these operations.

Variation F4

In the various embodiments described above, the active-matrix driving method was employed, but the present invention can also be applied where the organic EL element is driven using the passive-matrix method. However, because the need for high-speed driving is greater in a display device capable of multiple tones or a display device that uses the active-matrix driving method, the effect of the present invention is more remarkable in such a device. Furthermore, the present invention is not limited to a display device in which the pixel circuits are disposed in a matrix fashion, and can also be applied where a different pixel arrangement is used.

Variation F5

In the embodiments and variations described above, a display device using organic EL elements was described as an example, but the present invention can also be applied in a display device or electronic device using light emitting elements other than organic EL elements. For example, the present invention can be applied to a device having a different type of light emitting elements (such as LEDs or FEDs (Field Emission Displays)) that permit adjustment of the tone of light emission in accordance with the drive current.

Variation F6

The operations described in connection with the various embodiments above are merely examples, and different operations can be executed with respect to the pixel circuit of the present invention. For example, the pattern by which the gate signals V1–V3 are changed may be set to a different pattern than that used in the examples described above. Furthermore, it is acceptable if a determination is made regarding whether or not voltage programming is required and voltage programming is thereafter executed only if it is determined to be necessary. For example, the data signal that is supplied as a voltage signal may have a voltage value that corresponds to one of the available tones of the light emitting element. Alternatively, the number of available data signal voltage values may be smaller than the number of available light emission tones. In this case, one voltage value comprising a data signal corresponds to a range of light emission tones.

Variation F7

The pixel circuit of the various embodiments described above can be applied in the display devices of various types of electronic equipment, such as a personal computer, a cellular telephone, a digital still camera, a television, a viewfinder type or monitor screen type video tape recorder, a car navigation device, a pager, an electronic notebook, a calculator, a word processor, a workstation, a TV phone, a POS terminal or a device that includes a touch panel.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A pixel circuit for a light emitting element, comprising:

a current programming circuit that adjusts a tone of light emission from the light emitting element based on a current value of a current signal supplied via a current signal line by an external current generating circuit, the current programming circuit including:

(i) the light emitting element of a current-driven type;

(ii) a drive transistor disposed in a current path along which current travels to the light emitting element;

(iii) a holding capacitor, connected to a control electrode of the drive transistor, for setting a value of the current that is to flow through the drive transistor by maintaining a charge in accordance with the current value of the current signal supplied from the external current generating circuit; and (iv) a first switching transistor, connected between the holding capacitor and the data line, for controlling whether or not the holding capacitor should be charged using the current signal, and a second switching transistor, connected to the holding capacitor, for controlling whether or not the holding capacitor should be charged using a voltage signal supplied via a voltage signal line by an external voltage generating circuit.

2. A pixel circuit according to claim 1, further comprising a third switching transistor serially connected between the holding capacitor and the first switching transistor.

3. A pixel circuit according to claim 1, wherein the holding capacitor is charged such that the charging via the current signal is completed after the charging via the voltage signal is completed.

4. A pixel circuit according to claim 3, wherein the charging of the holding capacitors via the current signals is begun after the charging via the voltage signals is completed.

5. An electrooptical device that is driven using the active matrix driving method, comprising:

a pixel circuit matrix including a plurality of pixel circuits arranged in a matrix fashion, each pixel circuit including a light emitting element;

a plurality of scan lines that are respectively connected to pixel circuit rows aligned in a row direction of the pixel circuit matrix;

a plurality of data lines that are respectively connected to pixel circuit columns aligned in a column direction of the pixel circuit matrix;

a scan line driving circuit, connected to the plurality of scan lines, for selecting one row of the pixel circuit matrix; and a data signal generating circuit that can generate a data signal corresponding to a tone of light emission from the light emitting element and output the data signal to at least one of the plurality of data lines, wherein:

the data signal generating circuit includes a current generating circuit that generates a current signal output to the data line as a first data signal and a voltage generating circuit that generates a voltage signal output to the data line as a second data signal, and each pixel circuit includes:

a current programming circuit that adjusts the tone of the light emission from the light emitting element based on a current value of the current signal, the current programming circuit including:

(i) the light emitting element of a current-driven type;

(ii) a drive transistor disposed in a current path along which current travels to the light emitting element;

(iii) a holding capacitor, connected to a control electrode of the drive transistor, for setting a value of the current that is to flow through the drive transistor by maintaining a charge in accordance with the current value of the current signal supplied from the current generating circuit; and (iv) a first switching transistor, connected between the holding capacitor and the data line, for controlling whether or not the holding capacitor should be charged using the current signal, and a second switching transistor, connected to the holding capacitor, for controlling whether or not the holding capacitor should be charged using the voltage signal supplied by the voltage generating circuit.

6. An electrooptical device according to claim 5, wherein the data line for one column of pixel circuits includes a current signal line for transmitting the current signal and a voltage signal line for transmitting the voltage signal.

7. An electrooptical device according to claim 5, further comprising a third switching transistor serially connected between the holding capacitor and the first switching transistor.

8. An electrooptical device according to claim 5, wherein the holding capacitor is charged such that the charging via the current signal is completed after the charging via the voltage signal is completed.

9. An electrooptical device according to claim 8, wherein the charging of the holding capacitor via the current signal is begun after the charging via the voltage signal is completed.

10. A driving method for an electrooptical device that includes pixel circuits each including a current-driven light emitting element, a drive transistor disposed in a current path along which current travels to the light emitting element, and a holding capacitor that is connected to a control electrode of the drive transistor and sets a state of driving regarding the drive transistor, the driving method including the steps of:

(a) charging the holding capacitor by supplying a generated voltage signal (Vout) to the holding capacitor, and (b) causing the holding capacitor to maintain a charge commensurate with a tone of light emission from the light emitting element using a generated current signal (Iout) having a current value that matches the tone of the light emission at least after completion of the charging using the voltage signal.

11. A driving method according to claim 10, wherein the charging of the holding capacitor via the current signal is begun after the charging via the voltage signal is completed.

12. A driving method for an electrooptical device that includes pixel circuits, and a data line connected to the pixel circuits, each pixel circuit including a current-driven light emitting element, a drive transistor disposed in a current path along which current travels to the light emitting element, and a holding capacitor that is connected to a control electrode of the drive transistor and sets a state of driving regarding the drive transistor, the driving method including the steps of:

(a) charging or discharging both the holding capacitor and the data line by supplying a generated voltage signal (Vout) to the holding capacitor via the data line, and (b) causing the holding capacitor to maintain a charge commensurate with a tone of light emission from the light emitting element using a generated current signal (Iout) having a current value that matches the tone of the light emission at least after completion of the supply of the voltage signal.

* * * * *